US011052662B2

(12) United States Patent
Ficarra et al.

(10) Patent No.: US 11,052,662 B2
(45) Date of Patent: Jul. 6, 2021

(54) INKJET PRINTHEAD WIPER CLEANING SYSTEM HAVING CLEANING FLUID SUPPLIED BRUSH

(71) Applicant: Xerox Corporation, Norwalk, CT (US)

(72) Inventors: Richard P. Ficarra, Williamson, NY (US); Victoria L. Warner, Caledonia, NY (US); Richard A. Kalb, Rochester, NY (US); Douglas A. Gutberlet, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 16/705,289

(22) Filed: Dec. 6, 2019

(65) Prior Publication Data

US 2021/0170753 A1 Jun. 10, 2021

(51) Int. Cl.
*B41J 2/165* (2006.01)

(52) U.S. Cl.
CPC ..... *B41J 2/16541* (2013.01); *B41J 2/16538* (2013.01); *B41J 2/16552* (2013.01)

(58) Field of Classification Search
CPC ..... B41J 2/16541; B41J 2/16552
See application file for complete search history.

(56) References Cited

U.S. PATENT DOCUMENTS 4,252,448 A 2/1981 Johnson et al.
5,914,734 A * 6/1999 Rotering ..... B41J 2/16538 347/28
5,949,448 A * 9/1999 Man ..... B41J 2/16538 347/33
6,238,035 B1 5/2001 Barinaga
6,318,837 B1 11/2001 Barinaga
6,412,906 B1 7/2002 Lin
6,530,643 B1 * 3/2003 Askren ..... B41J 2/16535 347/33
6,739,696 B2 5/2004 Arai et al.
7,748,823 B2 7/2010 Hung
8,313,166 B2 11/2012 Pan
9,895,895 B2 2/2018 Ohnishi
2006/0021628 A1 * 2/2006 Mu ..... A46B 11/0013 132/116

(Continued)

FOREIGN PATENT DOCUMENTS

JP 62113553 A * 5/1987 ..... B41J 2/16538
WO 2008136207 A1 11/2008

*Primary Examiner* — Shelby L Fidler
(74) *Attorney, Agent, or Firm* — Gibb & Riley, LLC

(57) ABSTRACT

Inkjet printhead cleaning methods and systems control an articulation structure (that is connected to a wiper blade) to move the wiper blade to contact an inkjet printhead to wipe the inkjet printhead. These methods/systems further control the articulation structure to move the wiper blade to contact a blade cleaning structure to clean the wiper blade. The blade cleaning structure comprises a fluid manifold and bundles of fibers mounted in brush openings of the fluid manifold, and cleaning fluid is in the fluid manifold. The mounting ends of the bundles of fibers are mounted in the brush openings of the fluid manifold and the cleaning ends of the bundles of fibers are positioned to contact the wiper blade. The blade cleaning structure is positioned so as to gravity feed the cleaning fluid from the mounting ends of the fibers to the cleaning ends of the fibers.

17 Claims, 11 Drawing Sheets

(56) References Cited

U.S. PATENT DOCUMENTS

| | | | | |
|---|---|---|---|---|
| 2007/0263029 | A1* | 11/2007 | Watanabe | B41J 2/16538<br>347/33 |
| 2008/0197065 | A1* | 8/2008 | Wingo | B01D 39/1661<br>210/198.2 |
| 2009/0147045 | A1* | 6/2009 | Muraoka | B41J 2/16552<br>347/33 |
| 2016/0159097 | A1* | 6/2016 | Kerpe | B41J 2/16526<br>347/33 |

* cited by examiner

INKJET PRINTHEAD WIPER CLEANING SYSTEM HAVING CLEANING FLUID SUPPLIED BRUSH

BACKGROUND

Systems and methods herein generally relate to inkjet printers and more particularly to cleaning systems for cleaning wipers that wipe inkjet printheads.

For inkjet printers, the presence of residual ink on the face of a printhead (PH) can cause print defects. Therefore, it is important to keep the printhead surface clean. One way to accomplish this is by designing in a printhead maintenance (PHM) system. One instantiation of printhead maintenance is a flexible wiper blade that contacts the printhead and traverses across the face of the printhead to wipe away any excess ink. This action is most commonly performed after a purge, where a large volume of ink is flushed through the printhead to remove air bubbles and contaminants that could be clogging printhead jets.

A flexible wiper blade provides sufficient printhead cleaning for many ink types. However, some quick-drying inks harden on the printhead maintenance wiper blade before it has a chance to run off into a waste collection container. This hardened ink can contaminate the printhead during subsequent printhead maintenance routines, potentially damaging the printhead and causing image quality defects on prints.

SUMMARY

In order to address these issues, printing apparatuses and systems are provided herein that include an inkjet printhead having nozzles oriented toward a direction of gravity, a wiper blade adapted to contact the inkjet printhead, and a blade cleaning structure adapted to contact the wiper blade. The blade cleaning structure includes a fluid manifold adapted to maintain cleaning fluid (the fluid manifold includes brush openings) and bundles of fibers mounted in the brush openings of the fluid manifold.

Mounting ends of the bundles of fibers are mounted in the brush openings of the fluid manifold and extend from the brush openings in the direction of gravity. Also, cleaning ends of the bundles of fibers are positioned to contact the wiper blade. The mounting ends of the bundles of fibers are positioned relative to the cleaning ends of the bundles of fibers to gravity feed the cleaning fluid from the mounting ends to the cleaning ends. Also, the brush openings in the fluid manifold are positioned to gravity feed the cleaning fluid to the mounting ends of the bundles of fibers.

In order to meter the cleaning fluid, metered outlets of the fluid manifold have a diameter that is proportional to the viscosity of the cleaning fluid so as to limit the rate at which cleaning fluid is supplied to the bundles of fibers.

The wiper blade comprises an elongated structure oriented in a first direction, and the bundles of fibers of the blade cleaning structure comprise elongated bundles of fibers oriented in direction not parallel to the first direction. These structures further include a supply line connected to the fluid manifold. The supply line is adapted to supply the cleaning fluid to the fluid manifold.

An articulation structure is connected to the wiper blade. The articulation structure is adapted to move the wiper blade past the inkjet printhead to make contact with the inkjet printhead to wipe the inkjet printhead, and to move the wiper blade past the blade cleaning structure to make contact with the blade cleaning structure to clean the wiper.

Various methods for inkjet printhead cleaning control the articulation structure (that is connected to the wiper blade) using a processor to move the wiper blade to contact an inkjet printhead to wipe the inkjet printhead. These methods further control the articulation structure (again using the processor) to move the wiper blade to contact the blade cleaning structure to clean the wiper blade. The blade cleaning structure has a fluid manifold and bundles of fibers mounted in brush openings of the fluid manifold. These methods therefore maintain cleaning fluid in the fluid manifold.

The mounting ends of the bundles of fibers are mounted in the brush openings of the fluid manifold and the cleaning ends of the bundles of fibers are positioned to contact the wiper blade. Thus, these methods position the blade cleaning structure so that the mounting ends of the bundles of fibers are positioned relative to the cleaning ends of the bundles of fibers to gravity feed the cleaning fluid from the mounting ends to the cleaning ends.

These methods additionally position the blade cleaning structure so that the cleaning fluid gravity feeds to the mounting ends of the bundles of fibers. Also, the methods herein meter the release of the cleaning fluid by controlling the diameter of metered outlets of the fluid manifold to have the diameter proportional to the viscosity of the cleaning fluid, so as to limit the amount of cleaning fluid supplied to the bundles of fibers.

The wiper blade is an elongated structure oriented in a first direction. These methods orient the bundles of fibers of the blade cleaning structure in a direction not parallel to the first direction. Also, these methods can supply the cleaning fluid to the fluid manifold using a supply line connected to the fluid manifold.

These and other features are described in, or are apparent from, the following detailed description.

BRIEF DESCRIPTION OF THE DRAWINGS

Various exemplary systems and methods are described in detail below, with reference to the attached drawing figures, in which.

DETAILED DESCRIPTION

As mentioned above, some quick-drying inks harden on the printhead maintenance wiper blade before it has a chance to run off into a waste collection container. This hardened ink can contaminate the printhead during subsequent printhead maintenance routines, potentially damaging the printhead and causing image quality defects on prints.

Therefore, the systems and methods herein provide a printhead maintenance rinse system, where a brush and fluid manifold are used to meter wash fluid on the printhead maintenance wiper blades to clean off residual ink after a printhead maintenance routine is executed. The systems and methods herein take advantage of existing printhead movement hardware and minimize washing fluid use. This cuts down on customer expenses and reduces interactions with the machine (e.g., cleaning out waste containers, replacing washing fluid, etc.).

Printhead maintenance systems are a useful part of inkjet printers. Printhead maintenance hardware is used to keep printheads clean of residual ink, thus preventing image defects on the output prints. A wiper blade is used to clean the printhead in a squeegee-like fashion. Unfortunately, some inks dry so quickly that they harden and build up on the printhead maintenance hardware. This ink build-up can damage or contaminate the printhead in subsequent printhead maintenance routines.

To solve this problem, systems and methods herein provide a printhead maintenance rinse system. The printhead maintenance rinse systems herein apply a rinsing fluid to the printhead maintenance wiper blades in an effort to remove residual ink and prevent hardening/build-up. Also, a brush is mounted above the printhead maintenance hardware to meter rinse fluid onto the wiper blades as they traverse underneath. The bristle housing forms a fluid manifold with an inlet fitting where a fluid line can be connected as well as internal plumbing to evenly distribute the fluid along the bristles.

Upon contacting the wiper blade, the surface tension of the rinse fluid at the cleaning ends of the brush's fibers is broken, causing an even dispersion of fluid across the wiper blade. This ensures that any residual ink left on the blade is diluted and brushed/rinsed away. The diluted ink is then routed to an existing waste container where it is collected for future removal.

Thus, as shown below, the systems and methods herein provide a printhead maintenance hardware rinse system with customized brush to prevent ink hardening onto wiper blades. The systems and methods herein prevent ink hardening onto wiper blades, reduce frequency of wiper blade replacement, reduce occurrence of image defects due to printhead contamination, and reduce occurrence of printhead face plate damage due to contamination.

Figure 1:
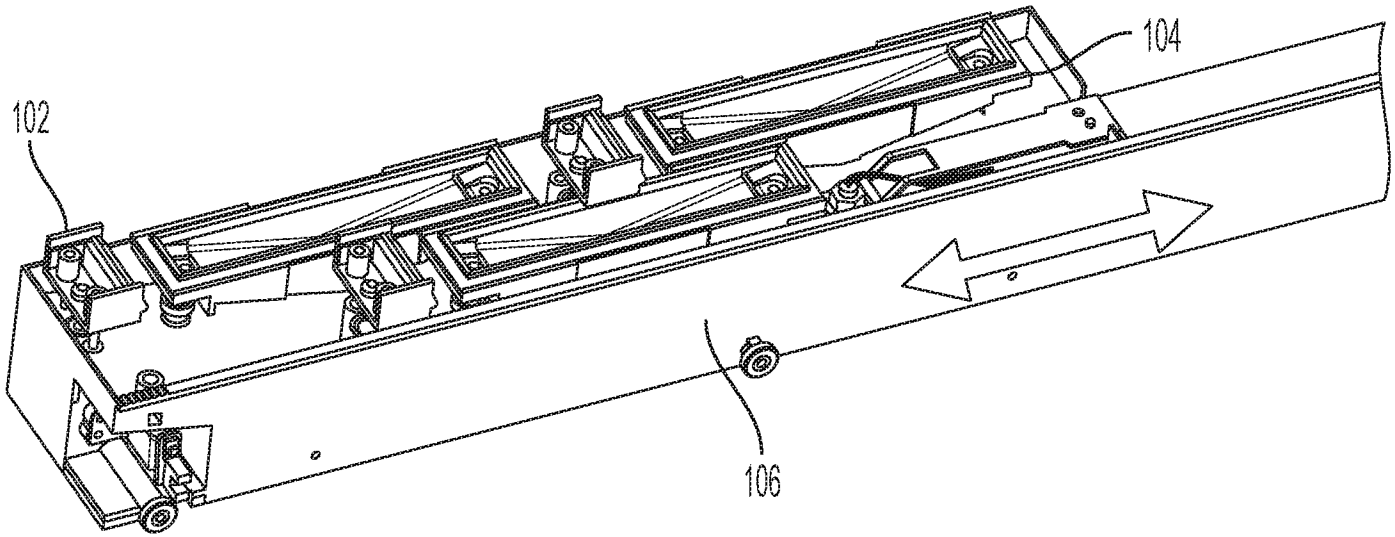
FIGS. 1-3 are perspective schematic diagrams illustrating components of printing devices herein.
Figure 2:
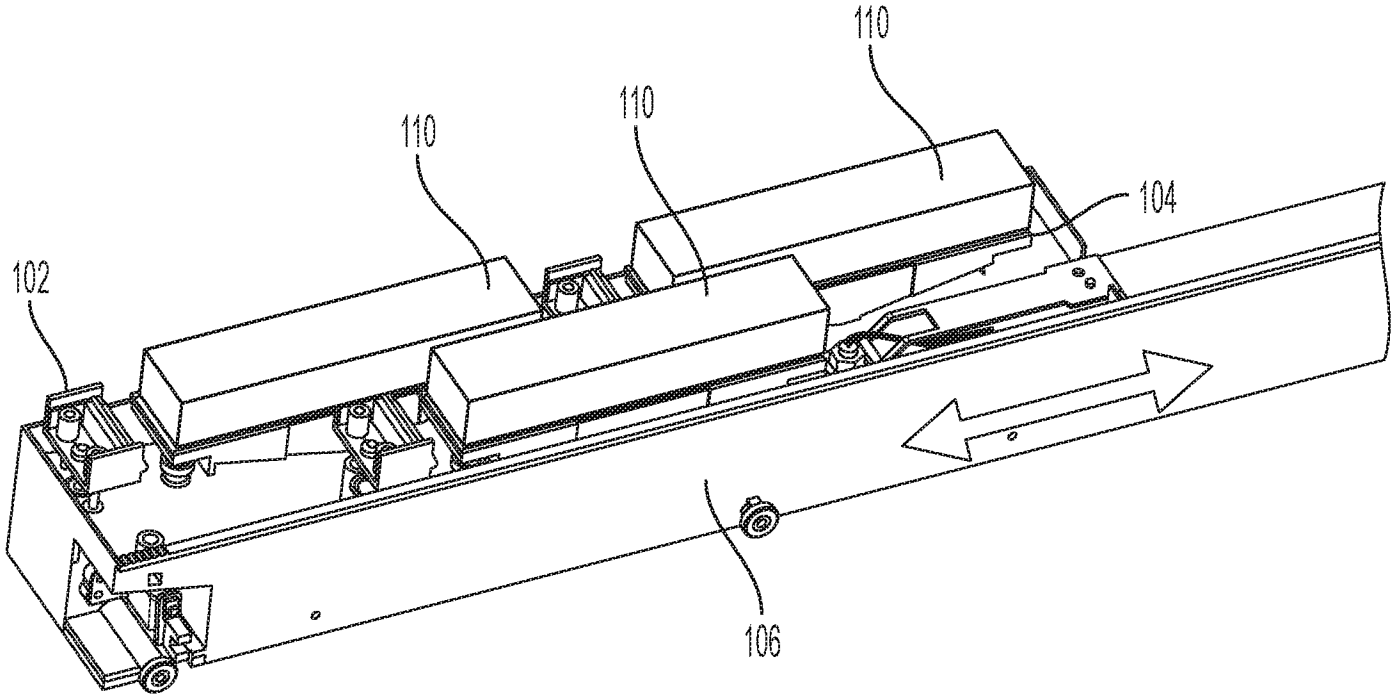
Figure 3:
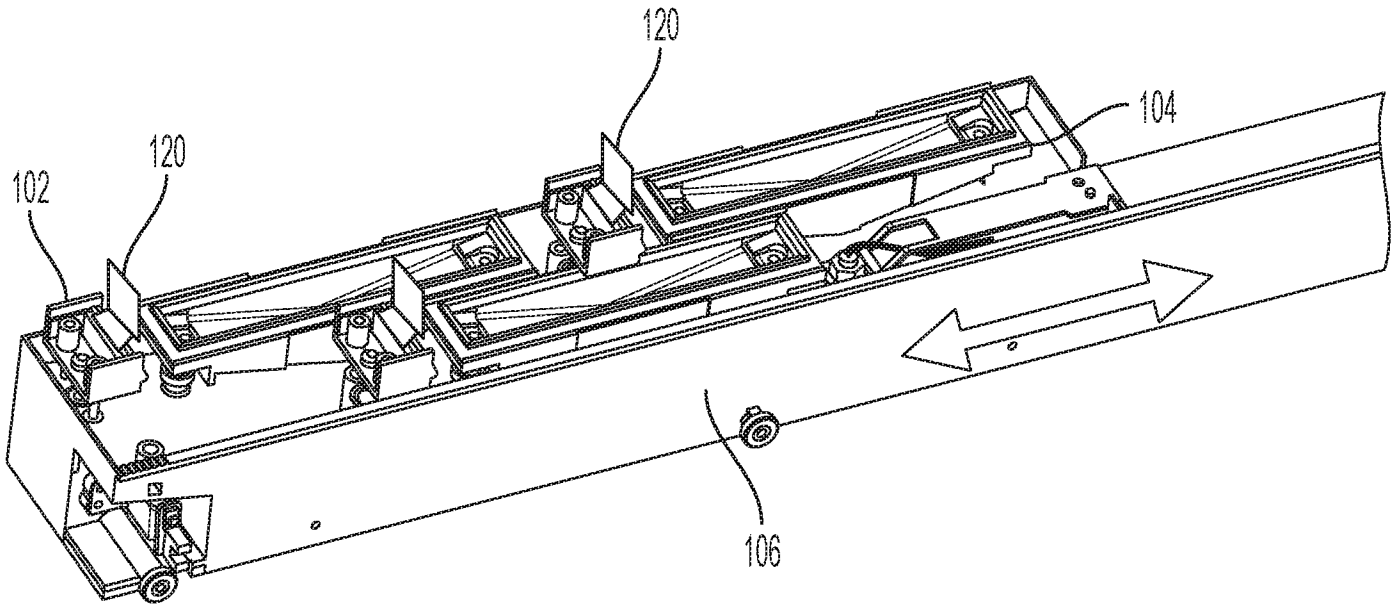

As shown in FIGS. 1-3 (which are perspective schematic diagrams illustrating components of printing devices herein) some elements herein move within the printing device using articulated structures, such as an articulated tray 106 (adapted to move in many directions), in which are mounted printhead storage caps 104 and wiper blades 102 (FIG. 1).

When not printing, as shown in FIG. 2, the tray 106 moves the storage caps 104 to the bottom of the printheads 110 to allow the printheads 110 to rest on and be protected by the storage caps 104. When printing is to resume, the printheads 110 are purged (sometimes while positioned on the storage caps 104). Specifically, the tray 106 can move the bottoms of printheads 110 across the wipers 102 to wipe any residual ink from the printheads 110.

Either after printing or after purging, the printheads 110 may undesirably have residual ink thereon and this residual ink can be wiped off the printheads 110 using the wiper blades 102, which may leave ink on the wiper blades 102. Thus, as shown in FIG. 3, the wipers 102 can be cleaned by further moving the tray 106 so that the wipers 102 make contact with, and are cleaned by, the blade cleaning structures 120.

Figure 4:
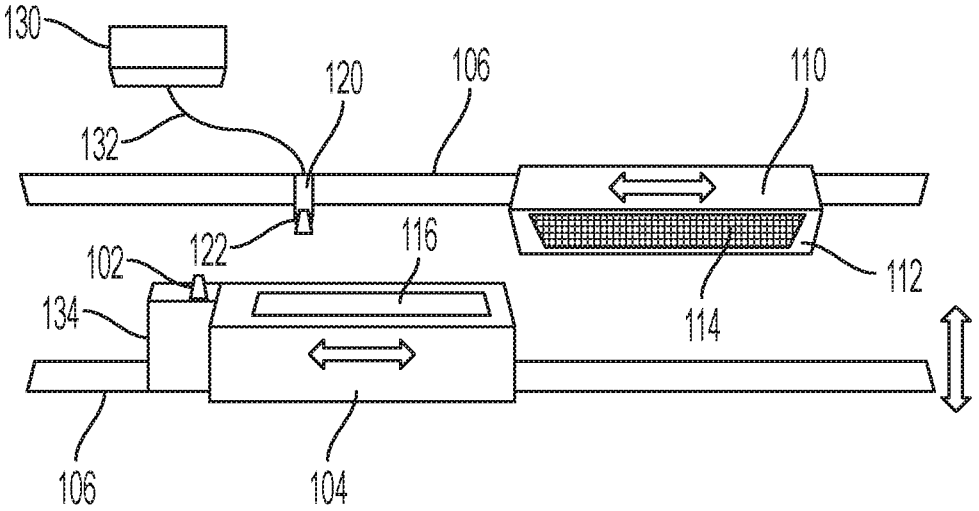
FIG. 4 is an expanded perspective schematic diagram illustrating components of printing devices herein.

FIG. 4 is an expanded (exploded) perspective schematic diagram showing the bottom of an inkjet printhead 110 having a nozzle plate or face plate 112 with nozzles 114 oriented downward (toward the direction of gravitational force), a wiper blade 102 adapted to contact and wipe the inkjet printhead 110, and a blade cleaning structure 120 adapted to contact and clean the wiper blade 102. The blade cleaning structure 120 includes brush bristles/fibers 122 that are gravity fed cleaning fluid received via a cleaning fluid supply line 132 connected to a cleaning fluid reservoir 130. Additionally, FIG. 4 illustrates that the storage caps 104 include a cavity 116 (FIGS. 1-3 and 5A-5C show that the cavity 116 can be V-shaped, but it can have other shapes depending upon implementation) in which dripping or purge ink from the nozzles 114 can be collected, drained, and potentially recycled.

As shown in FIG. 4, various elements of the articulation structure 106 (which can include multiple elements, only a few of which are shown) can be connected to the wiper blade 102 (and its mounting structure 134), the storage caps 104, the printhead 110, the blade cleaning structure 120, etc. While not shown in detail, the articulation structure 106 can include actuators or motors (hydraulic, electrical, pneumatic, etc.), cables, arms, axles, gears, etc., to move elements in many different directions (parallel, co-planar, orthogonal, perpendicular, etc.). Additionally, in some implementations, the blade cleaning structure 120 can be connected to the printhead 110 to move with the printhead 110. Similarly, in some implementations, the mounting structure 134 of the wiper blade 102 can be connected to the storage caps 104 to move with the storage caps 104. Further, the positions of the components in the drawings can be switched, altered, etc., to fit the internal confines of the printing device, to reduce power consumption, to increase reliability, and for other efficiencies.

Figure 5A:
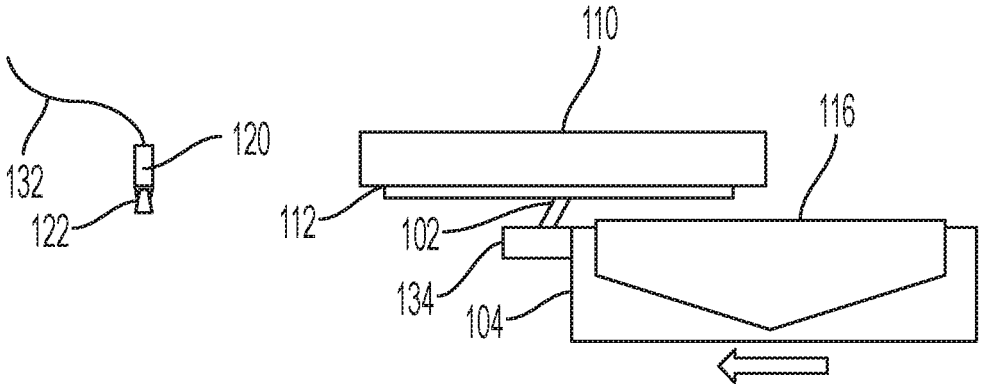
FIGS. 5A-5C are side-view schematic diagrams illustrating components of printing devices herein.

As shown by the block arrow in FIG. 5A, when in a non-printing mode (when not printing, purging, or in storage) and when the storage caps 104 are not being applied to the printhead 110, the articulation structure 106 (which is omitted from the following illustrations to avoid clutter) is adapted to move the wiper blade 102 past the inkjet printhead 110 to make contact with the inkjet printhead 110 to wipe any residual ink from the inkjet printhead 110. Note that in the example shown in FIG. 5A, the mounting structure 134 of the wiper blade 102 is connected to the storage cap 104, but as noted above many other configurations are possible.

Figure 5B:
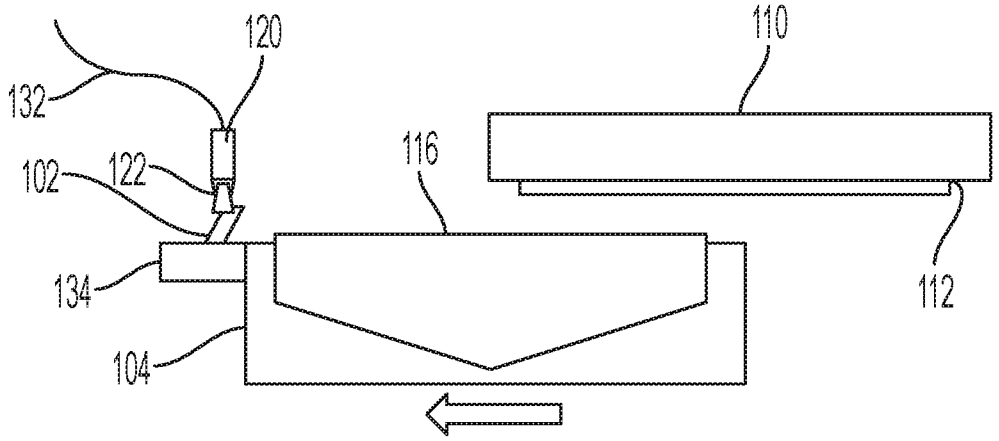
Figure 5C:
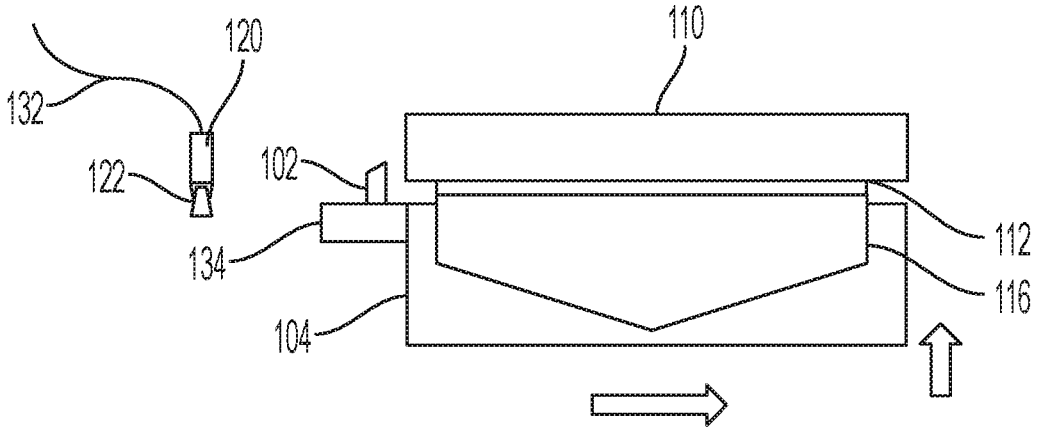

Again, the process of wiping the printhead 110 with the wiper blade 102 in FIG. 5A may cause ink to remain on the wiper blade 102. Therefore, as shown in FIG. 5B, the articulation structure 106 is used to move the wiper blade 102 past the fibers 122 of the blade cleaning structure 120 to make contact with the blade cleaning structure 120 to clean the wiper blade 102. Finally, as shown in FIG. 5C, the articulation structure 106 is used to move the storage cap 104 over and up against the faceplate 112 of the printhead 110 to seal the cavity 116 against the face plate 112. In other configurations, the printhead 110 could remain stationary and the wiper blade 102 could be moved past the printhead 110, and similarly the blade cleaning structure 120 could be moved past a stationary wiper blade 102 (using the articulation structure 106); but only one configuration is shown in the attached drawings to reduce redundancy and for brevity.

Figure 6:
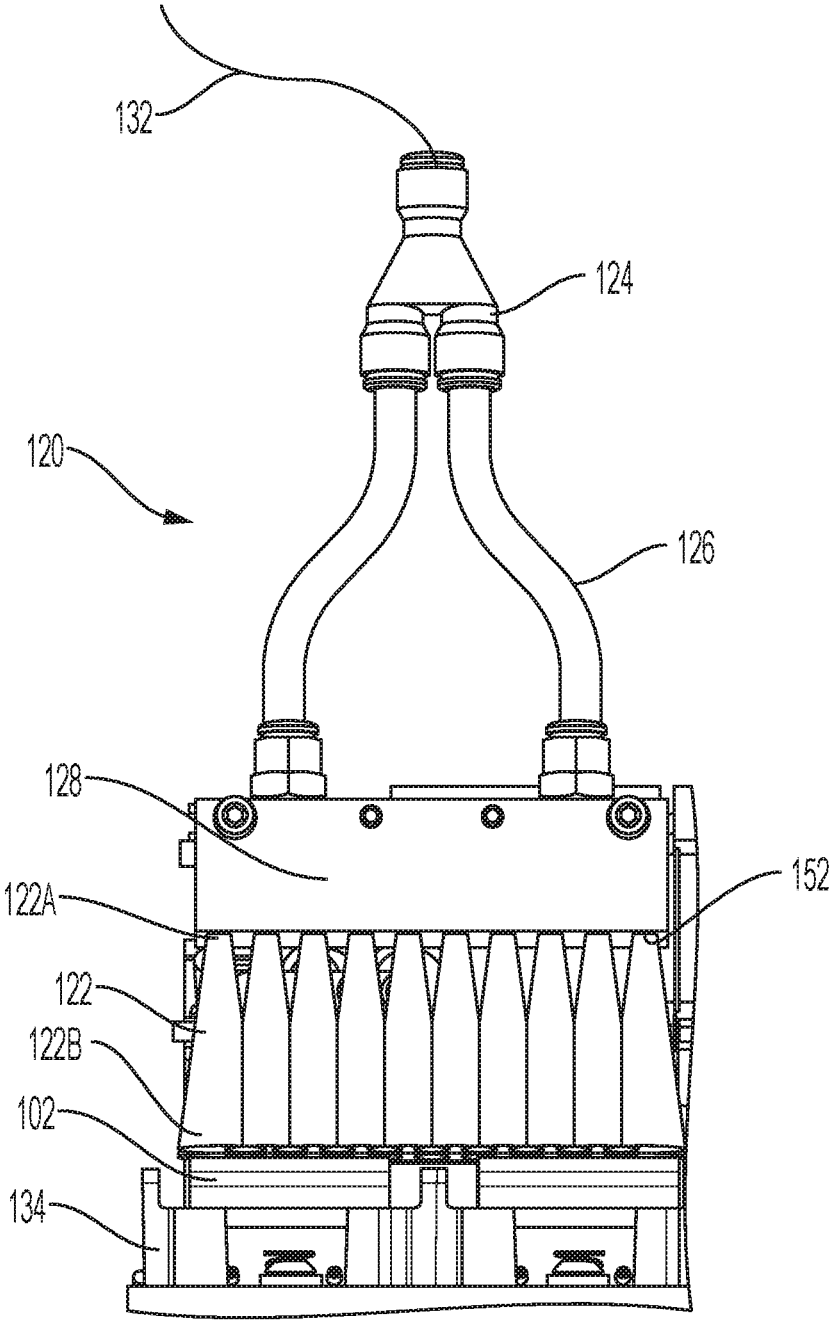
FIG. 6 is a front view schematic diagram illustrating a blade cleaning structure herein.
Figure 7:
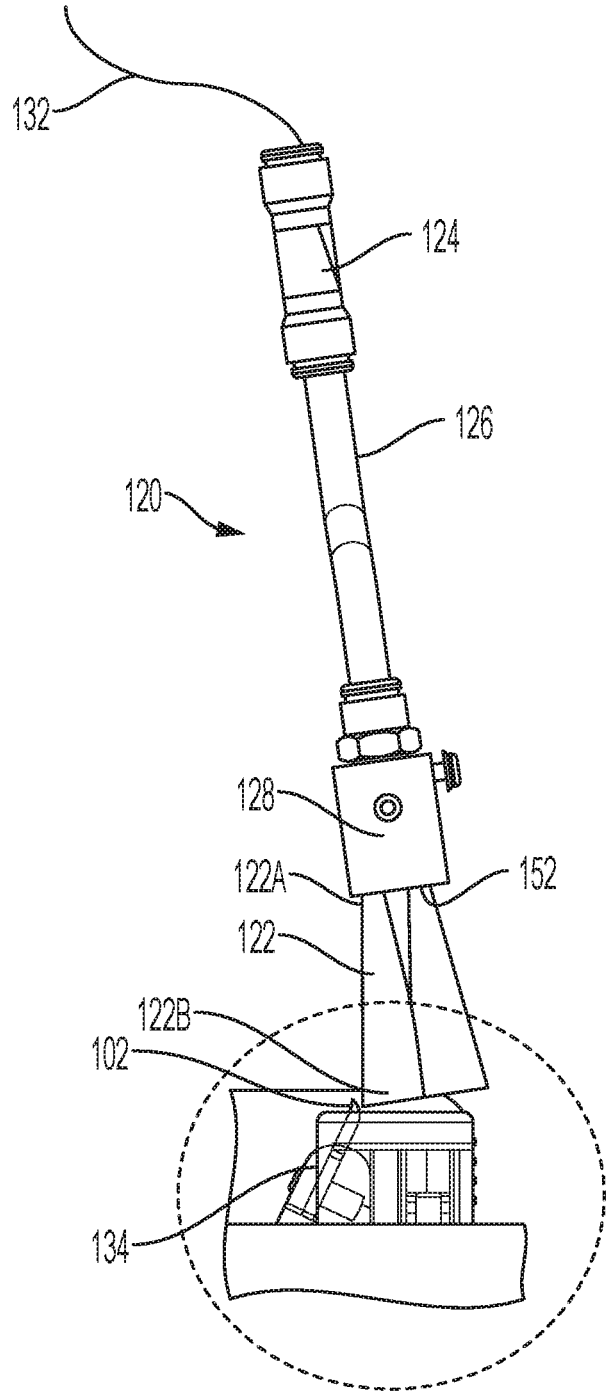
FIG. 7 is a side view schematic diagram illustrating the blade cleaning structure shown in FIG. 6.
Figure 8:
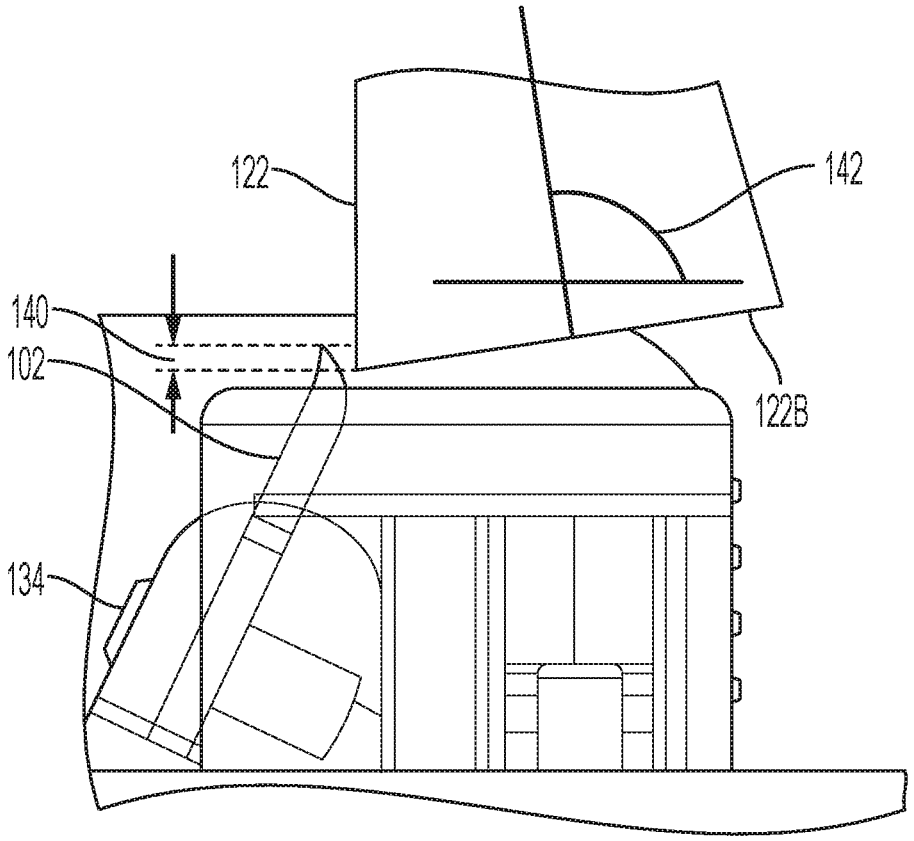
FIG. 8 is an expanded view schematic diagram illustrating a portion of the blade cleaning structure shown in FIG. 7.

FIG. 6 is a front view schematic diagram illustrating one exemplary blade cleaning structure herein, while FIG. 7 is a side view of the same, and FIG. 8 is an expanded view schematic diagram illustrating the circled portion of the blade cleaning structure shown in FIG. 7. Other arrangements of the same components shown are intended to be illustrated by this conceptual example shown in the attached drawings. As shown in FIGS. 6-8, the blade cleaning structure 120 includes a fluid manifold 128 adapted to maintain cleaning fluid (the fluid manifold 128 includes brush openings 152, shown in greater detail in FIGS. 10-11) and bundles of fibers 122 mounted in the brush openings 152 of the fluid manifold 128.

Mounting ends 122A of the bundles of fibers 122 are mounted in the brush openings 152 of the fluid manifold 128 and extend from the brush openings 152 in the direction of gravity. Also, cleaning ends 122B of the bundles of fibers 122 are positioned at the opposite ends of the fibers 122 to contact the wiper blade 102. The mounting ends 122A of the bundles of fibers 122 are positioned relative to the cleaning ends 122B of the bundles of fibers 122 to gravity feed the cleaning fluid that exits the fluid manifold 128 from the mounting ends 122A to the cleaning ends 122B.

These structures further include supply lines 132, 126 that supply the cleaning fluid to the fluid manifold 128. The supply lines 132, 136 can be connected together through an inlet 124 and, again, are gravity fed. With respect to the terms relating to gravitational direction used herein, a gravitational direction is any direction (e.g., potentially within a 179° of the then-current ground plane) which is fully or partially toward the source of gravitational pull (e.g., the ground, the floor, the center of the Earth). Therefore, the direction of gravity herein does not necessarily need to be straight toward the ground, but simply must be a direction that will allow the cleaning fluid to flow on its own using some amount of gravitational force, without pumps or other motivational sources.

As shown in FIGS. 7 and 8, the wiper blade 102 comprises an elongated structure oriented in a first direction, and the bundles of fibers 122 of the blade cleaning structure 120 comprise elongated bundles of fibers 122 oriented in second, non-parallel, direction to the first direction. More specifically, the wiper blade 102 is shown in FIGS. 7 and 8 as being at one angle relative to the top of the mounting structure 134, while the center line between the fibers 122 is shown as being at a second, different angle 142 relative to the top of the mounting structure 134, and therefore the two are not parallel to one another.

In the example shown in FIG. 8, the cleaning ends 122B of the fibers 122 can have a flat surface, but the fibers 122 could have a rounded surface, a pointed surface, an angled surface, etc. Also note that because of the angle 142, there is an overlap distance 140 where at least a portion of the fibers 122 overlap and make contact down a distance of the wiper blade 102. Additionally, the non-parallel angle 142 causes the fibers 122 to irregularly contact (e.g., snap across) the end of the wiper blade 102, which encourages release of the cleaning fluid from the cleaning end 122B of the fibers 122 and provides agitation which promotes cleaning the ink from the wiper blade 102.

Figure 9:
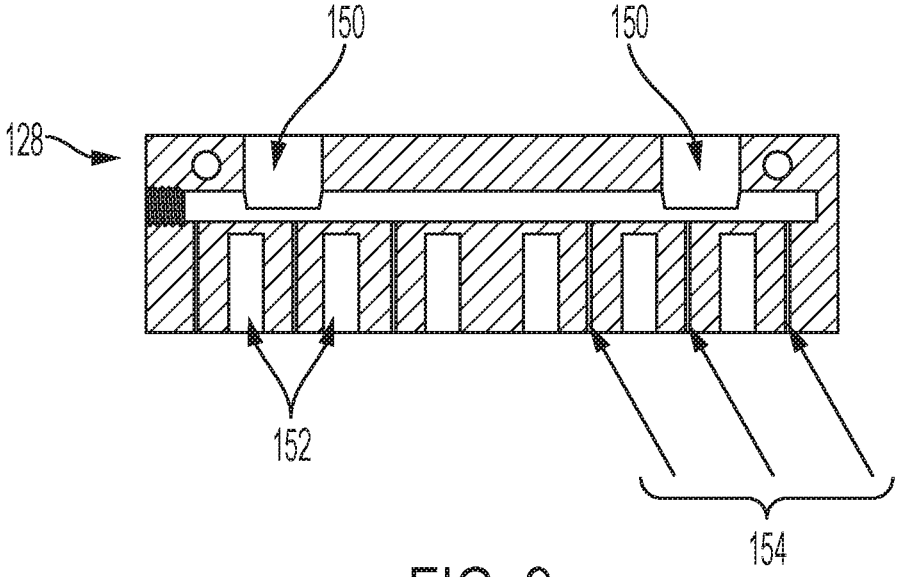
FIG. 9 is a cross-sectional schematic diagram illustrating the fluid manifold structure herein.
Figure 10:
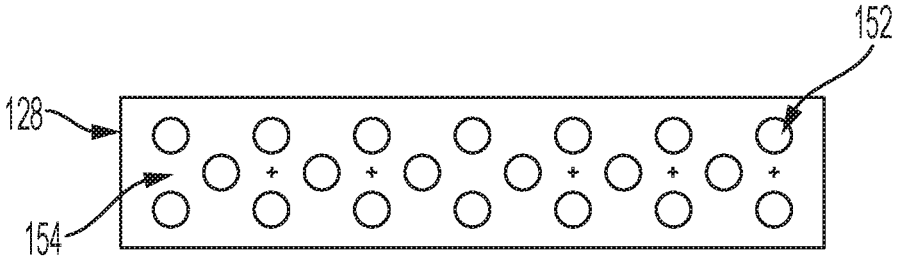
FIG. 10 is a bottom-view schematic diagram illustrating the fluid manifold structure herein.

FIG. 9 is a cross-sectional schematic diagram illustrating one specific example of the fluid manifold 128 herein and FIG. 10 is a bottom-view of the same. FIG. 9 illustrates the inlet ports 150 that are connected to the supply lines 126. FIG. 10 also illustrates the brush openings 152 and metered outlets 154 which output the cleaning fluid. As shown, the metered outlets 154 are in gravity-fed fluid communication with the supply lines 132, 126. Note that as shown in FIG. 9, the metered outlets 154 are between the brush openings 152 and this causes the cleaning fluid released from the metered outlets 154 to reach between the bundles fibers 122 and (through gravitational force) run down between the fibers 122 until eventually reaching the cleaning end 122B of the fibers 122.

FIG. 10 shows the brush openings 152 and metered outlets 154 at the bottom of the fluid manifold 128. As again shown in FIG. 10, the metered outlets 154 are between the brush openings 152 to causes the cleaning fluid to reach the fibers 122. In order to meter the cleaning fluid, the metered outlets 154 have a diameter that is proportional to the viscosity of the cleaning fluid so as to limit the amount of cleaning fluid released. In some examples, lower viscosity cleaning fluids may use smaller diameter metered outlets 154, higher viscosity cleaning fluids may use larger diameter metered outlets 154, relatively higher flow rates of cleaning fluids may use larger diameter metered outlets 154, relatively lower flow rates of cleaning fluids may use larger diameter metered outlets 154, etc. Therefore, again, this minimizes cleaning fluid usage and thereby cuts down on user expenses and reduces user interactions with the machine.

In the example shown in FIG. 10, there are three rows of brush openings 152 (there could be more or less); however, there is only a single row of metered outlets 154 (there could be more or less) in line with the center row of the brush openings 152. Additionally, while only one brush example is illustrated for brevity and to just illustrate the concepts presented herein, structures herein can include smaller or larger brush openings 152, more or less brush openings 152, a different pattern of brush openings 152, etc., depending upon brush design. Similarly, structures herein can include more or less metered outlets 154, a different pattern of metered outlets 154, etc., depending upon brush design. This arrangement is established to keep the cleaning fluid within the center of the rows of bundles of fibers 122, which keeps the cleaning fluid between the bundles of fibers 122 and from running down the outer surfaces of the outer rows of the bundles of fibers 122 (or at least minimizes the amount of cleaning fluid on such outer surfaces).

By maintaining the cleaning fluid within the center of the rows of the bundles of fibers 122, less of the cleaning fluid evaporates or drips from the outer surfaces of the outer rows of the bundles of fibers 122, which reduces the amount of cleaning fluid utilized. This saves the user money by reducing the amount of cleaning fluid utilized and reduces user interaction by having to refill the cleaning fluid less often Therefore, again, the structures and methods herein cut down on user expenses and reduce user interactions with the machine.

Figure 11:
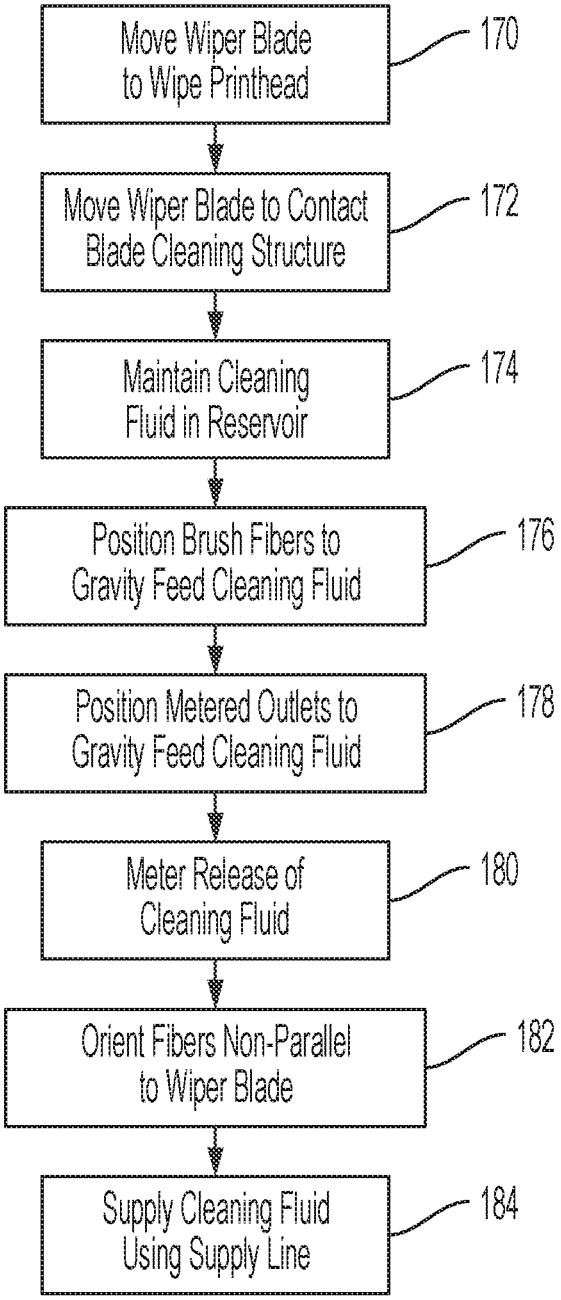
FIG. 11 is a flow diagram of various methods herein.

FIG. 11 is a flowchart showing exemplary methods herein. The processes shown in FIG. 11 can be performed in any order. In item 170, these methods for inkjet printhead cleaning control the articulation structure (that is connected to the wiper blade) using a processor to move the wiper blade to contact an inkjet printhead to wipe the inkjet printhead. In item 172, these methods further control the articulation structure (again using the processor) to move the wiper blade to contact the blade cleaning structure to clean the wiper blade. The blade cleaning structure has a fluid manifold and bundles of fibers mounted in brush openings of the fluid manifold. In item 174, these methods therefore maintain cleaning fluid in the fluid manifold.

The mounting ends of the bundles of fibers are mounted in the brush openings of the fluid manifold and the cleaning ends of the bundles of fibers are positioned to contact the wiper blade. Thus, these methods position the blade cleaning structure so that the mounting ends of the bundles of fibers are positioned relative to the cleaning ends of the bundles of fibers to gravity feed the cleaning fluid from the mounting ends to the cleaning ends (item 176).

These methods additionally position the blade cleaning structure so that the metered outlets in the fluid manifold gravity feed the cleaning fluid to the mounting ends of the bundles of fibers in item 178. Also, in item 180, the methods herein meter the release of the cleaning fluid by controlling metered outlets of the fluid manifold to have a diameter proportional to the viscosity of the cleaning fluid, so as to limit the cleaning fluid output to the bundles of fibers.

The wiper blade is an elongated structure oriented in a first direction. In item 182, these methods orient the bundles of fibers of the blade cleaning structure in a direction not parallel to the first direction. Also, in item 184, these methods can supply the cleaning fluid to the fluid manifold using a supply line connected to the fluid manifold.

Figure 12:
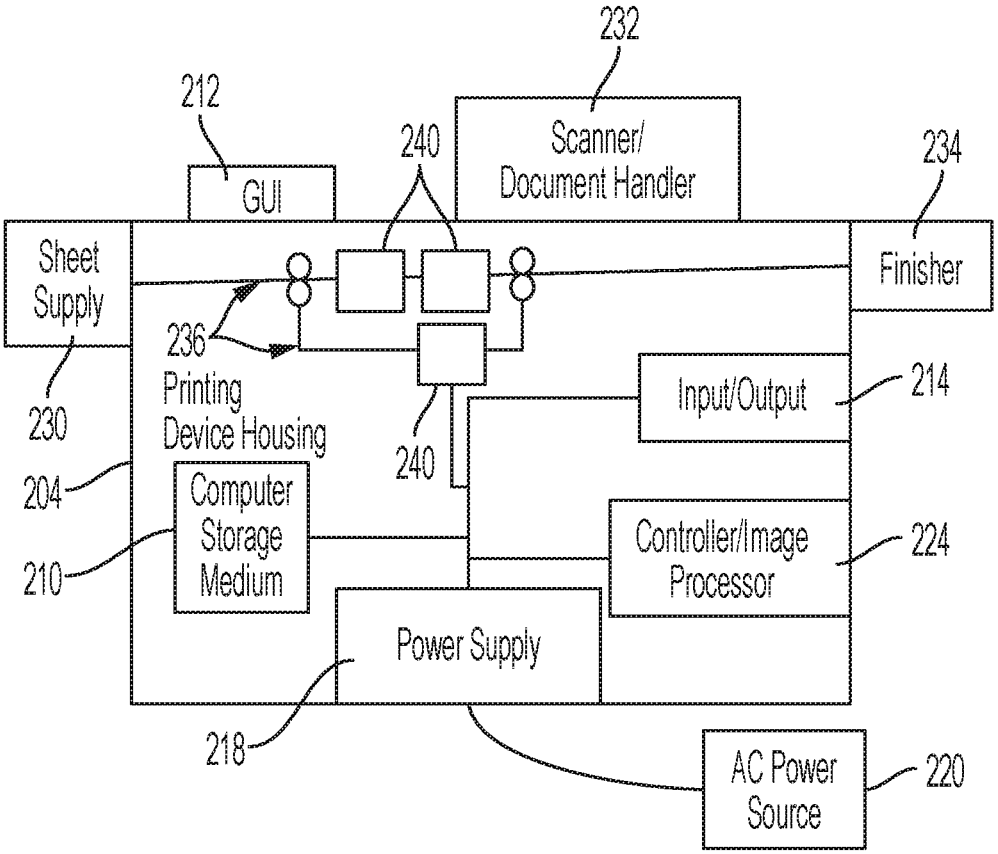
FIG. 12 is a schematic diagram illustrating devices herein.

FIG. 12 illustrates many components of printer structures 204 herein that can comprise, for example, a printer, copier, multi-function machine, multi-function device (MFD), etc. The printing device 204 includes a controller/tangible processor 224 and a communications port (input/output) 214 operatively connected to the tangible processor 224 and to a computerized network external to the printing device 204. Also, the printing device 204 can include at least one accessory functional component, such as a user interface (UI) assembly 212. The user may receive messages, instructions, and menu options from, and enter instructions through, the graphical user interface or control panel 212.

The input/output device 214 is used for communications to and from the printing device 204 and comprises a wired device or wireless device (of any form, whether currently known or developed in the future). The tangible processor 224 controls the various actions of the printing device 204. A non-transitory, tangible, computer storage medium device 210 (which can be optical, magnetic, capacitor based, etc., and is different from a transitory signal) is readable by the tangible processor 224 and stores instructions that the tangible processor 224 executes to allow the computerized device to perform its various functions, such as those described herein. Thus, as shown in FIG. 12, a body housing has one or more functional components that operate on power supplied from an alternating current (AC) source 220 by the power supply 218. The power supply 218 can comprise a common power conversion unit, power storage element (e.g., a battery, etc.), etc.

The printing device 204 includes at least one marking device (printing engine(s)) 240 that include the structures shown in FIGS. 1-10 and use marking material, and are operatively connected to the specialized image processor 224 (which can be different from a general purpose computer because it can be specialized for processing image data), a media path 236 positioned to supply continuous media or sheets of media from a sheet supply 230 to the marking device(s) 240, etc. After receiving various markings from the printing engine(s) 240, the sheets of media can optionally pass to a finisher 234 which can fold, staple, sort, etc., the various printed sheets. Also, the printing device 204 can include at least one accessory functional component (such as a scanner/document handler 232 (automatic document feeder (ADF)), etc.) that also operate on the power supplied from the external power source 220 (through the power supply 218).

Therefore, the processor 224 controls the articulation structure (that is connected to the wiper blade) to move the wiper blade to contact an inkjet printhead to wipe the inkjet printhead. The processor 224 further controls the articulation structure to move the wiper blade to contact the blade cleaning structure to clean the wiper blade.

The one or more printing engines 240 are intended to illustrate any marking device that applies marking material (toner, inks, plastics, organic material, etc.) to continuous media, sheets of media, fixed platforms, etc., in two- or three-dimensional printing processes, whether currently known or developed in the future. The printing engines 240 can include, for example, devices that use inkjet printheads, contact printheads, three-dimensional printers, etc.

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

Many computerized devices are discussed above. Computerized devices that include chip-based central processing units (CPU's), input/output devices (including graphic user interfaces (GUI), memories, comparators, tangible processors, etc.) are well-known and readily available devices produced by manufacturers such as Dell Computers, Round Rock Tex., USA and Apple Computer Co., Cupertino Calif., USA. Such computerized devices commonly include input/output devices, power supplies, tangible processors, electronic storage memories, wiring, etc., the details of which are omitted herefrom to allow the reader to focus on the salient aspects of the systems and methods described herein. Similarly, printers, copiers, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The systems and methods herein can encompass systems and methods that print in color, monochrome, or handle color or monochrome image data. All foregoing systems and methods are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user. Additionally, terms such as "adapted to" mean that a device is specifically designed to have specialized internal or external components that automatically perform a specific operation or function at a specific point in the processing described herein, where such specialized components are physically shaped and positioned to perform the specified operation/function at the processing point indicated herein (potentially without any operator input or action). In the drawings herein, the same identification numeral identifies the same or similar item.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the systems and methods herein cannot be implied or imported from any above example as limitations to any particular order, number, position, size, shape, angle, color, or material.

What is claimed is:

1. A printing apparatus comprising:

an inkjet printhead having nozzles oriented toward a direction of gravity;

a wiper blade adapted to contact the inkjet printhead; and a blade cleaning structure adapted to contact the wiper blade, wherein the blade cleaning structure comprises:

a fluid manifold adapted to maintain cleaning fluid; and fibers connected to the fluid manifold at metered outlets in the fluid manifold, wherein mounting ends of the fibers are connected to the fluid manifold and are in contact with the cleaning fluid, wherein cleaning ends of the fibers are positioned to contact the wiper blade, and wherein the mounting ends of the fibers are positioned relative to the cleaning ends of the fibers to gravity feed the cleaning fluid from the mounting ends to the cleaning ends.

2. The printing apparatus according to claim 1, wherein the metered outlets in the fluid manifold are positioned to gravity feed the cleaning fluid to the mounting ends of the fibers.

3. The printing apparatus according to claim 1, wherein the metered outlets of the fluid manifold have a diameter proportional to a viscosity of the cleaning fluid.

4. The printing apparatus according to claim 1, wherein the wiper blade comprises an elongated structure oriented in a first direction, and wherein the fibers of the blade cleaning structure comprise elongated fibers oriented in direction other than parallel to the first direction.

5. The printing apparatus according to claim 1, further comprising a supply line connected to the fluid manifold, wherein the supply line is adapted to supply the cleaning fluid to the fluid manifold.

6. The printing apparatus according to claim 1, further comprising an articulation structure connected to the wiper blade, wherein the articulation structure is adapted to move the wiper blade past the inkjet printhead to make contact with the inkjet printhead and move the wiper blade past the blade cleaning structure to make contact with the blade cleaning structure.

7. A printing apparatus comprising:

an inkjet printhead having nozzles oriented toward a direction of gravity;

a wiper blade adapted to contact the inkjet printhead; and a blade cleaning structure adapted to contact the wiper blade, wherein the blade cleaning structure comprises:

a fluid manifold adapted to maintain cleaning fluid, wherein the fluid manifold includes brush openings; and bundles of fibers mounted in the brush openings of the fluid manifold, wherein mounting ends of the bundles of fibers are mounted in the brush openings of the fluid manifold and extend from the brush openings in the direction of gravity, wherein cleaning ends of the bundles of fibers are positioned to contact the wiper blade, and wherein the mounting ends of the bundles of fibers are positioned relative to the cleaning ends of the bundles of fibers to gravity feed the cleaning fluid from the mounting ends to the cleaning ends.

8. The printing apparatus according to claim 7, wherein metered outlets of the fluid manifold are positioned to gravity feed the cleaning fluid to the mounting ends of the bundles of fibers.

9. The printing apparatus according to claim 7, wherein metered outlets of the fluid manifold have a diameter proportional to a viscosity of the cleaning fluid.

10. The printing apparatus according to claim 7, wherein the wiper blade comprises an elongated structure oriented in a first direction, and wherein the bundles of fibers of the blade cleaning structure comprise elongated bundles of fibers oriented in direction other than parallel to the first direction.

11. The printing apparatus according to claim 7, further comprising a supply line connected to the fluid manifold, wherein the supply line is adapted to supply the cleaning fluid to the fluid manifold.

12. The printing apparatus according to claim 7, further comprising an articulation structure connected to the wiper blade, wherein the articulation structure is adapted to move the wiper blade past the inkjet printhead to make contact with the inkjet printhead and move the wiper blade past the blade cleaning structure to make contact with the blade cleaning structure.

13. An inkjet printhead cleaning method comprising:

controlling an articulation structure connected to a wiper blade using a processor to move the wiper blade to contact an inkjet printhead to wipe the inkjet printhead;

controlling the articulation structure using the processor to move the wiper blade to contact a blade cleaning structure to clean the wiper blade, wherein the blade cleaning structure comprises a fluid manifold and bundles of fibers mounted in brush openings of the fluid manifold;

maintaining cleaning fluid in the fluid manifold, wherein mounting ends of the bundles of fibers are mounted in the brush openings of the fluid manifold, and wherein cleaning ends of the bundles of fibers are positioned to contact the wiper blade; and positioning the blade cleaning structure such that the mounting ends of the bundles of fibers are positioned relative to the cleaning ends of the bundles of fibers to gravity feed the cleaning fluid from the mounting ends to the cleaning ends.

14. The inkjet printhead cleaning method according to claim 13, further comprising positioning the blade cleaning structure such that metered outlets of the fluid manifold gravity feed the cleaning fluid to the mounting ends of the bundles of fibers.

15. The inkjet printhead cleaning method according to claim 13, further comprising metering release of the cleaning fluid by controlling metered outlets of the fluid manifold to have a diameter proportional to a viscosity of the cleaning fluid.

16. The inkjet printhead cleaning method according to claim 13, wherein the wiper blade comprises an elongated structure oriented in a first direction, and wherein the method further comprises orienting the bundles of fibers of the blade cleaning structure in direction other than parallel to the first direction.

17. The inkjet printhead cleaning method according to claim 13, further comprising supplying the cleaning fluid to the fluid manifold using a supply line connected to the fluid manifold.

* * * * *